US005842431A

United States Patent [19]

Wu

[11] Patent Number: 5,842,431

[45] Date of Patent: Dec. 1, 1998

[54] ROTATING SHUTTLE AND PRESSER PLATE ARRANGEMENT

[76] Inventor: Chong-Ming Wu, 2F, No. 6, Lane 8, Ming-Feng Street, Hsi-Chin Chen, Taipei Hsien, Taiwan

[21] Appl. No.: 801,356

[22] Filed: Feb. 19, 1997

[51] Int. Cl.[6] ..... D05B 57/10; D05B 57/20

[52] U.S. Cl. ..... 112/232

[58] Field of Search ..... 112/185, 189, 112/191, 192, 193, 196, 228, 230, 231, 232

[56] References Cited

U.S. PATENT DOCUMENTS 4,142,475 3/1979 Zocher ..... 112/231 X
4,453,479 6/1984 Kawai ..... 112/231
4,676,178 6/1987 Hirose ..... 112/231
5,152,236 10/1992 Hirose ..... 112/231

*Primary Examiner*—Paul C. Lewis
*Attorney, Agent, or Firm*—Bacon & Thomas

[57] ABSTRACT

A shuttle bobbin and presser plate arrangement including a first magnetic element and a second magnetic element respectively mounted on a shuttle bobbin in a rotating shuttle and a presser plate, which prohibits the shuttle bobbin from escaping out of the rotating shuttle, the first magnetic element and the second magnetic element producing a magnetic repulsion force against each other to keep the shuttle bobbin spaced from the presser plate at a constant distance for the passing of an upper thread.

2 Claims, 4 Drawing Sheets

ROTATING SHUTTLE AND PRESSER PLATE ARRANGEMENT

BACKGROUND OF THE INVENTION

The present invention relates to sewing machines, and more specifically to a rotating shuttle and presser plate arrangement of a sewing machine which keeps the shuttle bobbin spaced from the presser plate at a constant distance for the passing of an upper thread.

A sewing machine is generally comprises of a needle mounted on a needle bar and vertically reciprocated to carry an upper thread through the cloth to be stitched, a rotating shuttle holding a shuttle bobbin and an under-thread spool in the shuttle bobbin and alternatively turned forwards and backwards to move an under thread relative to the upper thread, causing the under thread and the upper thread to be stitched up on the cloth. In order to prevent the shuttle bobbin from escaping out of the rotating shuttle, a presser plate is disposed above the shuttle bobbin. Although the shuttle bobbin is prohibited from escaping out of the rotating shuttle by the presser plate, it will be forced to displace during the movement of the rotating shuttle, thereby causing the upper thread passage between the shuttle bobbin and the presser plate to be reduced, or eliminated, and therefore the upper thread tends to be jammed.

SUMMARY OF THE INVENTION

The present invention provides a rotating shuttle and presser bar arrangement which eliminates the aforesaid problem. According to the present invention, two magnetic elements are respectively mounted on the shuttle bobbin and the presser plate to produce a magnetic repulsion force against each other, so that the upper thread passage which is defined between the shuttle bobbin and the presser plate is constantly maintained unchanged during stitching.

DETAILED DESCRIPTION OF THE PREFERRED EMBODIMENT

Figure 1:
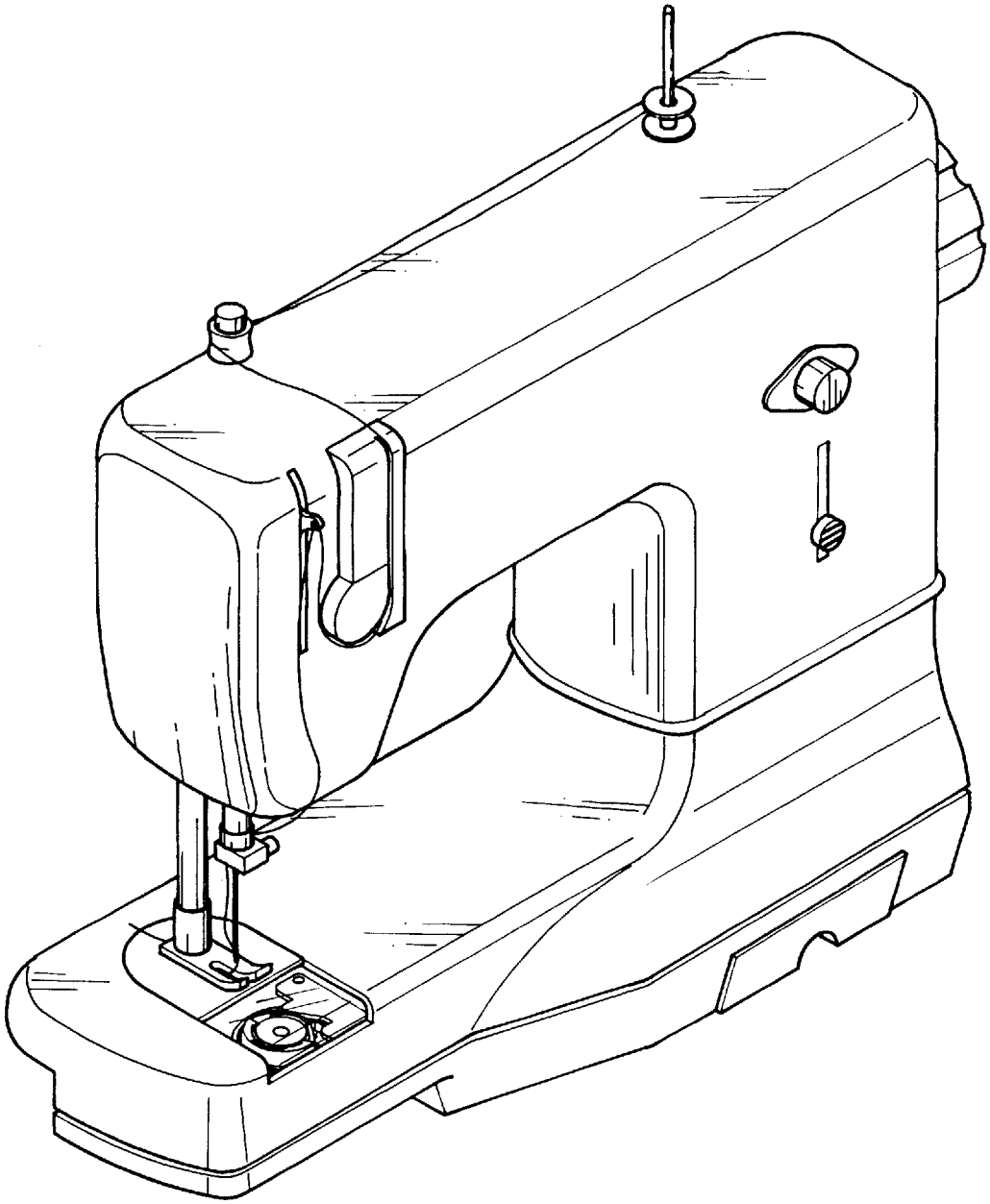
FIG. 1 is a perspective elevation of a sewing machine.
Figure 2:
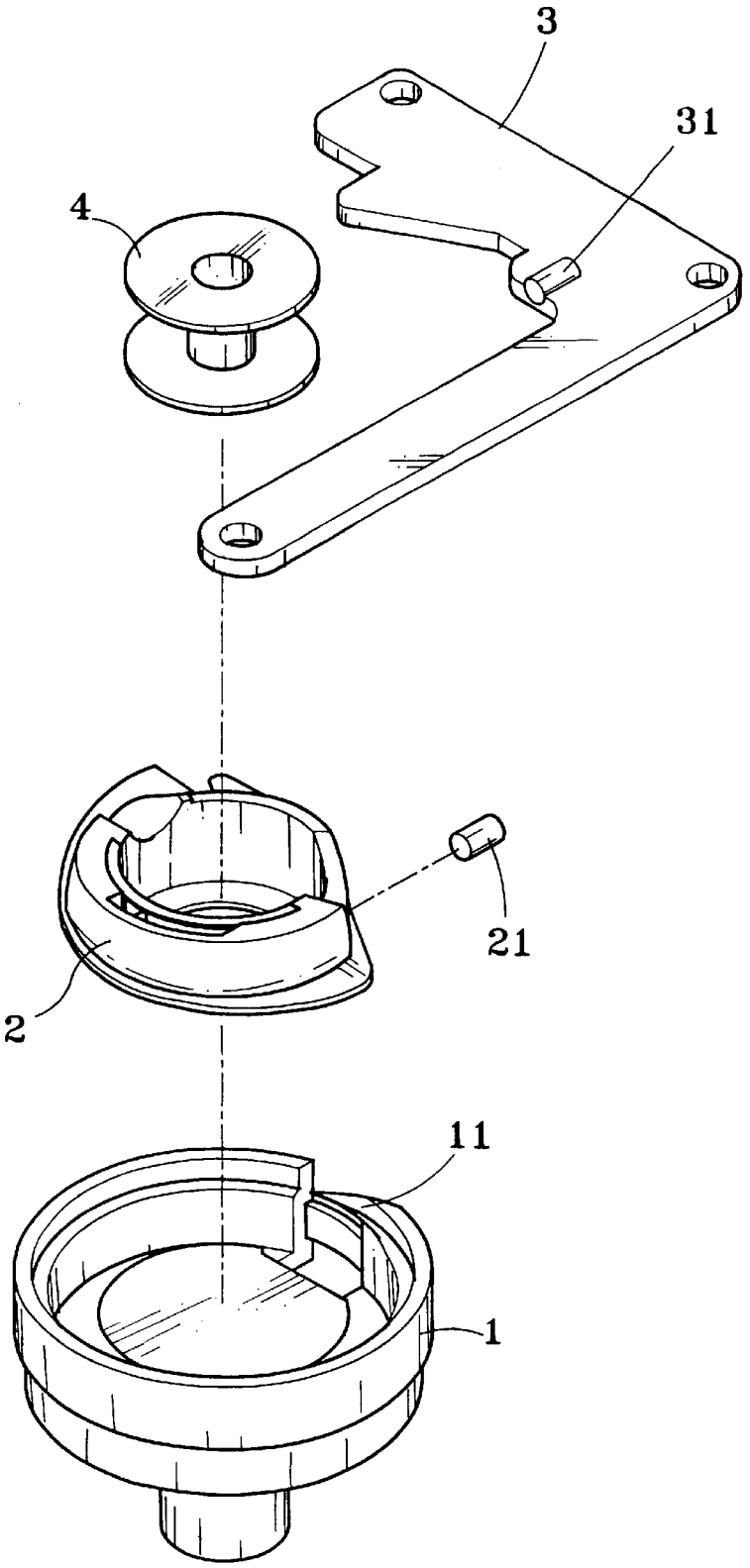
FIG. 2 is an exploded view of a rotating shuttle and presser plate arrangement according to the present invention.
Figure 3:
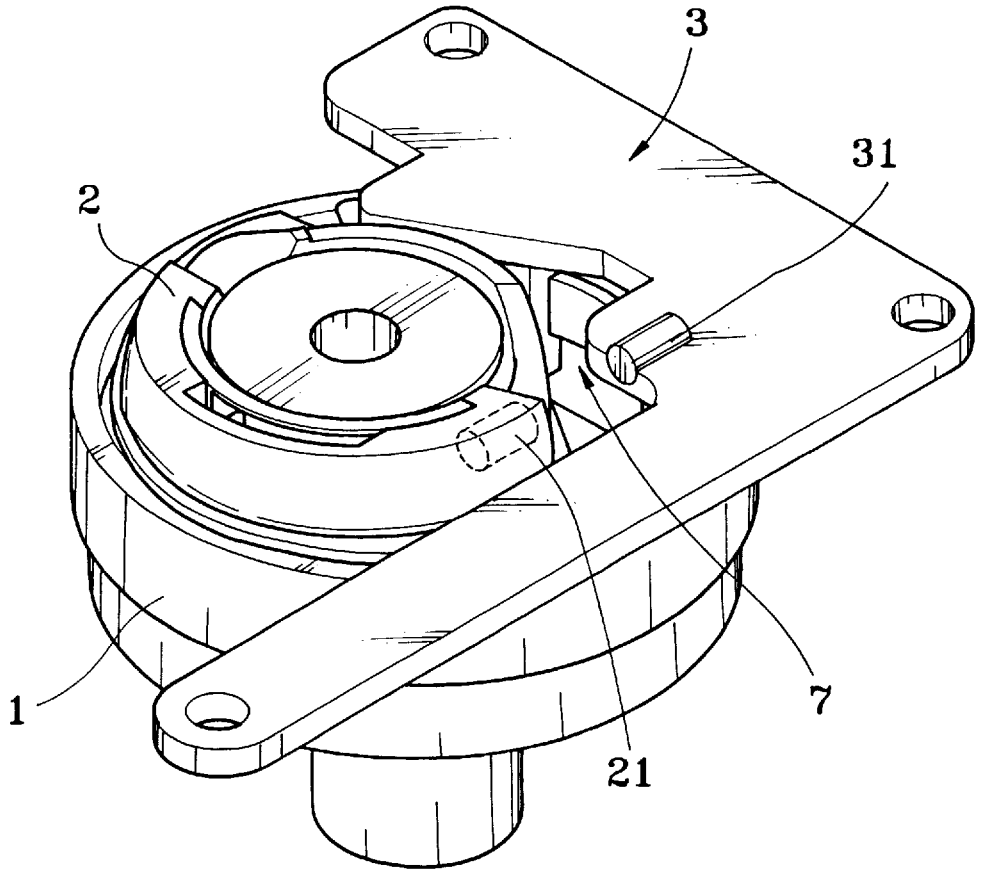
FIG. 3 is a perspective elevation of the present invention.

Referring to FIGS. 2 and 3, a rotating shuttle and pressure plate arrangement in accordance with the present invention comprises a cup-like rotating shuttle 1, a shuttle bobbin 2 mounted within the rotating shuttle 1 and holding an under-thread spool 4, a presser plate 3 disposed above the shuttle bobbin 2 to prohibit the shuttle bobbin 2 from escaping out of the rotating shuttle 1, a first magnetic element 21 mounted on the shuttle bobbin 2, and a second magnetic element 31 mounted on the presser plate 3 to act against the first magnetic element 21.

Figure 4A:
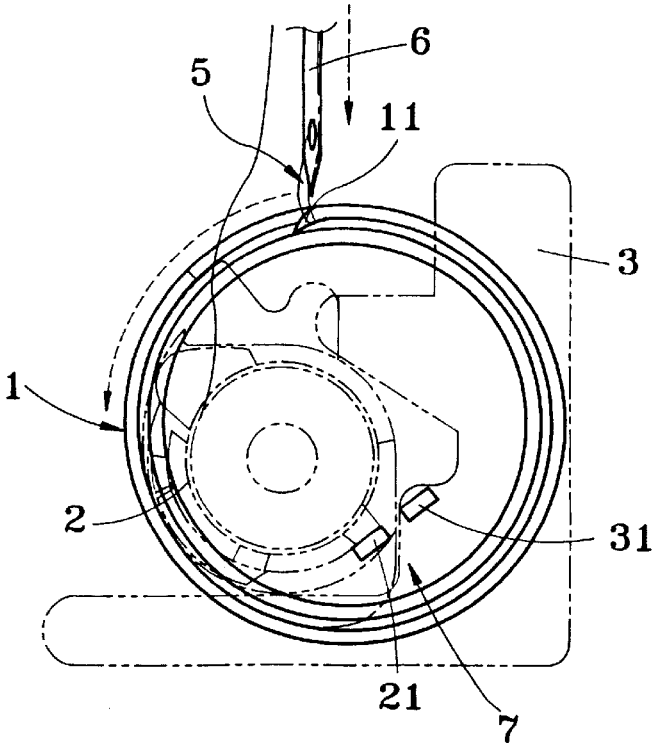
FIG. 4A is schematic drawing showing the down stroke of the needle and the operation of the present invention.
Figure 4B:
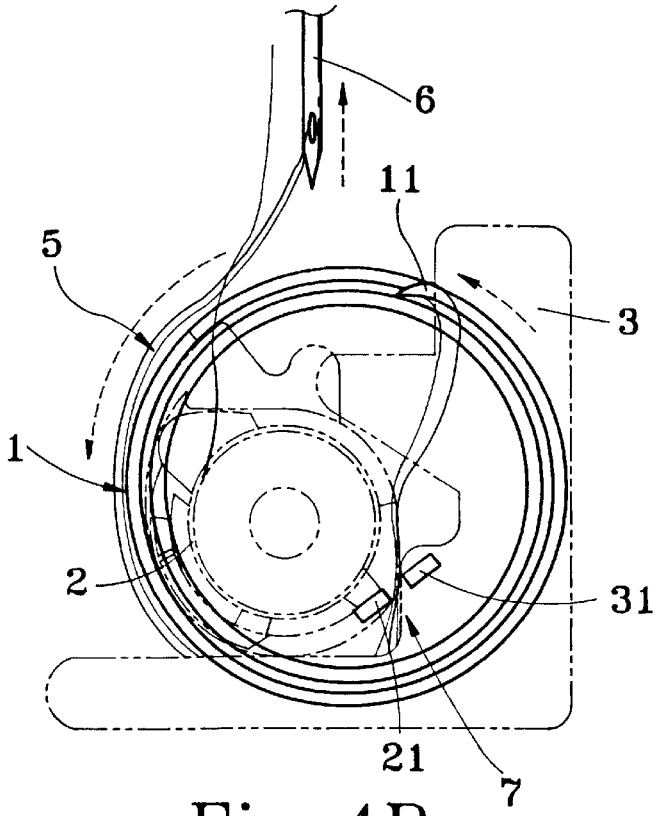
FIG. 4B is a schematic drawing showing the up stroke of the needle and the operation of the present invention.

Referring to FIGS. 4A and 4B, when the sewing machine is operated, the upper thread 5 is firstly carried by the needle 6 through the cloth to the lower limit position (during the down stroke of the needle 6). At the beginning of the return stroke (up stroke) of the needle 6, the upper thread 5 is forced by the cloth to form a loop in the shuttle course of the hook 11 of the rotating shuttle 1, and the loop thus forced is then pulled by the hook 11 of the rotary shuttle 1 and guided by the gap between the rotating shuttle 1 and the shuttle bobbin 2 to expand and to be mounted around the periphery of the shuttle bobbin 2.

Although the shuttle bobbin 2 is prohibited from escaping out of the rotating shuttle 1 by the presser plate 3, it will be forced to displace rightwards when the rotating shuttle 1 is alternatively turned forwards and backwards, thereby causing the gap 7 between the shuttle bobbin 2 and the presser plate 3 to be reduced, or eliminated. If the gap 7 is reduced or eliminated, the upper thread 5 will be jammed.

The arrangement of the first magnetic element 21 and the second magnetic element 31 eliminates the aforesaid problem. The first magnetic element 21 and the second magnetic element 31 are respectively mounted on the shuttle bobbin 2 and the presser plate 3 at two opposite sides of the gap 7, and longitudinally aligned. The first magnetic element 21 and the second magnetic element 31 have the same pole aimed at each other. Therefore a magnetic repulsion force is produced between the first magnetic element 21 and the second magnetic element 31 to keep the shuttle bobbin 2 spaced from the presser plate 3 at a constant distance for the passing of the upper thread 5.

I claim:

1. A shuttle bobbin and presser plate arrangement comprising a rotating shuttle, a shuttle bobbin mounted within said rotating shuttle to hold an under-thread spool, and a presser plate disposed above said shuttle bobbin to prohibit said shuttle bobbin from escaping out of said rotating shuttle, wherein a first element and a second element are respectively mounted on said shuttle bobbin and said presser plate and longitudinally aligned, said first element and said second element producing a repulsion force against each other to keep said shuttle bobbin spaced from said pressure plate at a constant distance for the passing of an upper thread.

2. The shuttle bobbin and presser plate arrangement of claim 1 wherein said first element and said second element are magnetic elements.

* * * * *